US008763431B2

(12) United States Patent
Kim et al.

(10) Patent No.: US 8,763,431 B2
(45) Date of Patent: Jul. 1, 2014

(54) WASHING MACHINE

(75) Inventors: Dongyoon Kim, Changwon-si (KR); Youngbae Park, Changwon-si (KR); Seongno Yoon, Changwon-si (KR); Kichul Cho, Changwon-si (KR); Younggon Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 912 days.

(21) Appl. No.: 12/845,450

(22) Filed: Jul. 28, 2010

(65) Prior Publication Data

US 2011/0062837 A1 Mar. 17, 2011

Related U.S. Application Data

(60) Provisional application No. 61/230,590, filed on Jul. 31, 2009.

(30) Foreign Application Priority Data

| | | |
|---|---|---|
| Jul. 31, 2009 | (KR) | 10-2009-0071056 |
| Nov. 12, 2009 | (KR) | 10-2009-0109294 |
| Nov. 12, 2009 | (KR) | 10-2009-0109296 |

(51) Int. Cl.

| | |
|---|---|
| ***D06F 37/00*** | (2006.01) |
| ***D06F 37/18*** | (2006.01) |
| ***D06F 37/28*** | (2006.01) |
| ***B65D 43/14*** | (2006.01) |
| ***B65D 43/22*** | (2006.01) |
| ***B65D 43/24*** | (2006.01) |
| ***B65D 51/04*** | (2006.01) |

(52) U.S. Cl.
USPC ..... 68/3 R; 68/196; 220/810; 220/827; 220/828; 220/829; 220/830

(58) Field of Classification Search
USPC ..... 68/3 R, 196
See application file for complete search history.

(56) References Cited

U.S. PATENT DOCUMENTS

| | | | | |
|---|---|---|---|---|
| 5,448,900 | A * | 9/1995 | Cuthbert et al. | 68/139 |
| 6,275,999 | B1 * | 8/2001 | Fujita | 4/236 |
| 2008/0010778 | A1 * | 1/2008 | Tse | 16/82 |
| 2009/0064458 | A1 | 3/2009 | Vanini | |

FOREIGN PATENT DOCUMENTS

| | | | |
|---|---|---|---|
| CN | 201099780 | Y | 8/2008 |
| CN | 101324023 | A | 12/2008 |
| JP | 4-38997 | A | 2/1992 |
| JP | 2005-304643 | A | 11/2005 |

* cited by examiner

*Primary Examiner* — Joseph L Perrin
*Assistant Examiner* — Levon J Shahinian
(74) *Attorney, Agent, or Firm* — Birch, Stewart, Kolasch & Birch, LLP

(57) ABSTRACT

A washing machine comprising a cabinet open at an upper portion, a top cover coupled to the upper portion of the cabinet and including an opening for loading and unloading laundry therethrough, a lid assembly rotatably coupled to the top cover to open and close the opening, and a first hinge unit connecting the lid assembly with the top cover and reducing a speed of closing the lid assembly is provided. In the washing machine, the closing speed of the lid assembly is reduced to mitigate shock between the lid assembly and the top cover.

27 Claims, 17 Drawing Sheets

WASHING MACHINE

This application claims priority to Korean Patent Application No. 10-2009-0071056 filed on Jul. 31, 2009, No. 10-2009-0109296 filed on Nov. 12, 2009, No. 10-2009-0109294 filed on Nov. 12, 2009 in the Korean Intellectual Property Office, U.S. Provisional Application No. 61/230,590 filed on Jul. 31, 2009 in the United States Patent and Trademark Office, the contents of which are incorporated herein by reference in their entirety.

BACKGROUND OF THE INVENTION

1. Field of the Invention

This disclosure is directed to a washing machine, and more specifically, to a washing machine that may control a speed of opening/closing a lid assembly to improve convenience of use and feel of operation.

2. Discussion of the Related Art

In general, a washing machine may include a laundry washer that gets rid of contaminants from clothing or bedding (hereinafter, referred to as "laundry") using a chemical action between water and detergent and a mechanical action, and a dryer that dries wet laundry using hot air heated by a heater and a mechanical action. Also, a washing machine may have both a washing function and a drying function. Further, a washing machine may also include a refresher that sprays hot steam to laundry to smooth out wrinkles therefrom. A washing machine may include various devices that exert physical or chemical actions to laundry.

The washing machine sequentially performs a washing cycle, a rinsing cycle, and a dehydrating cycle to wash the laundry. Any one of the cycles may be only conducted according to user's selection. The laundry may be washed by a proper method according to the type of laundry.

A washing machine includes a body in which the laundry is washed and a door rotatably coupled to the body. The impact of the door on the body when the door is closed may cause a problem with durability of the washing machine. Further, if the door is made of metal or includes a glass window to allow a user to view the inside of the body, the weight of the door is increased, thus rendering it difficult to open the door.

SUMMARY OF THE INVENTION

Exemplary embodiments of the present invention provide a washing machine including a lid assembly that may be easily opened with less force and closed with less impact on a top cover by reducing rotation speed.

According to an embodiment, a washing machine includes a lid assembly that may be automatically opened or closed with respect to an opening angle of 90 degrees and less.

According to an embodiment of the present invention, there is provided a washing machine comprising: a cabinet open at an upper portion; a top cover coupled to the upper portion of the cabinet and including an opening for loading and unloading laundry therethrough; a lid assembly rotatably coupled to the top cover to open and close the opening; and a first hinge unit connecting the lid assembly with the top cover and reducing a speed of closing the lid assembly.

According to an embodiment of the present invention, there is provided a washing machine comprising: a cabinet open at an upper portion; a top cover coupled to the upper portion of the cabinet and including an opening for loading and unloading laundry therethrough; a lid assembly rotatably coupled to the top cover to open and close the opening; and a first hinge unit connecting the lid assembly with the top cover, wherein the first hinge unit controls the lid assembly to be closed without external force in a first section as a closing speed of the lid assembly is reduced, and to be opened without external force in a second section including an open angle of 90 degrees or less.

According to an embodiment of the present invention, there is provided a washing machine comprising: a cabinet open at an upper portion; a top cover coupled to the upper portion of the cabinet and including an opening for loading and unloading laundry therethrough; a lid assembly rotatably coupled to the top cover to open and close the opening; and a first hinge unit connecting the lid assembly with the top cover, wherein when the lid assembly rotates for closing, the first hinge unit reduces a rotating speed of the lid assembly in a first section, and increases a rotating speed of the lid assembly in a third section after the first section is passed.

According to an embodiment of the present invention, there is provided a washing machine comprising: a cabinet open at an upper portion; a top cover coupled to the upper portion of the cabinet and including an opening for loading and unloading laundry therethrough; a lid assembly rotatably coupled to the top cover to open and close the opening; and a first hinge unit connecting the lid assembly with the top cover and generating a torque in a direction of opening the lid assembly to reduce a speed of closing the lid assembly.

According to an embodiment of the present invention, there is provided a washing machine comprising: a cabinet open at an upper portion; a top cover coupled to the upper portion of the cabinet and including an opening for loading and unloading laundry therethrough; and a door unit rotatably coupled to the top cover to open and close the opening, wherein the door unit is closed without an external force in a first section as the rotating speed of the door unit being decreased, and opened without an external force in a second section including an open angle of 90 degrees and less.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
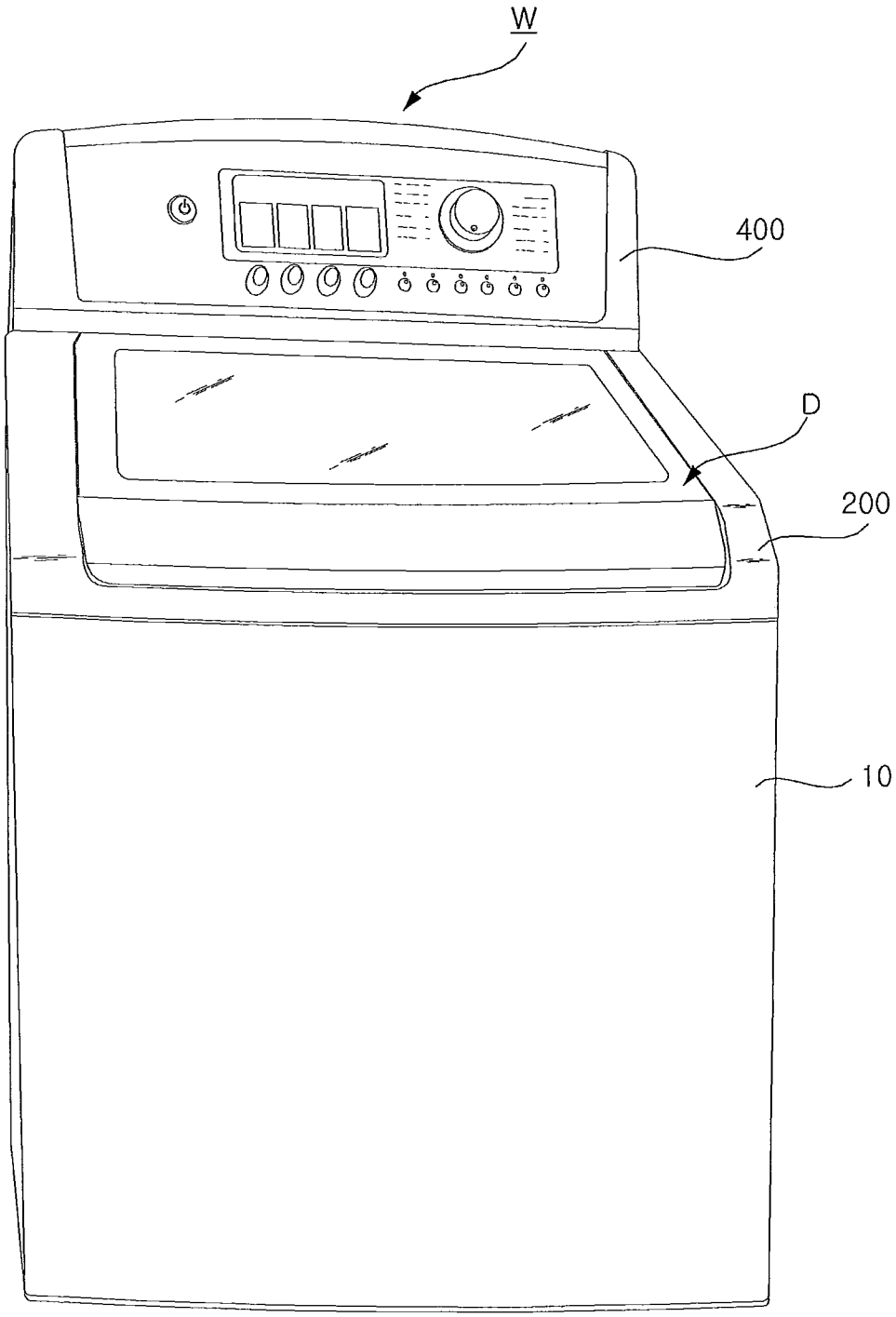
FIG. 1 is a perspective view illustrating a washing machine according to an embodiment of the present invention.

The foregoing and other objects, features, aspects and advantages of the present invention will become more apparent from the following detailed description of the present invention when taken in conjunction with the accompanying drawings. Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

Figure 2:
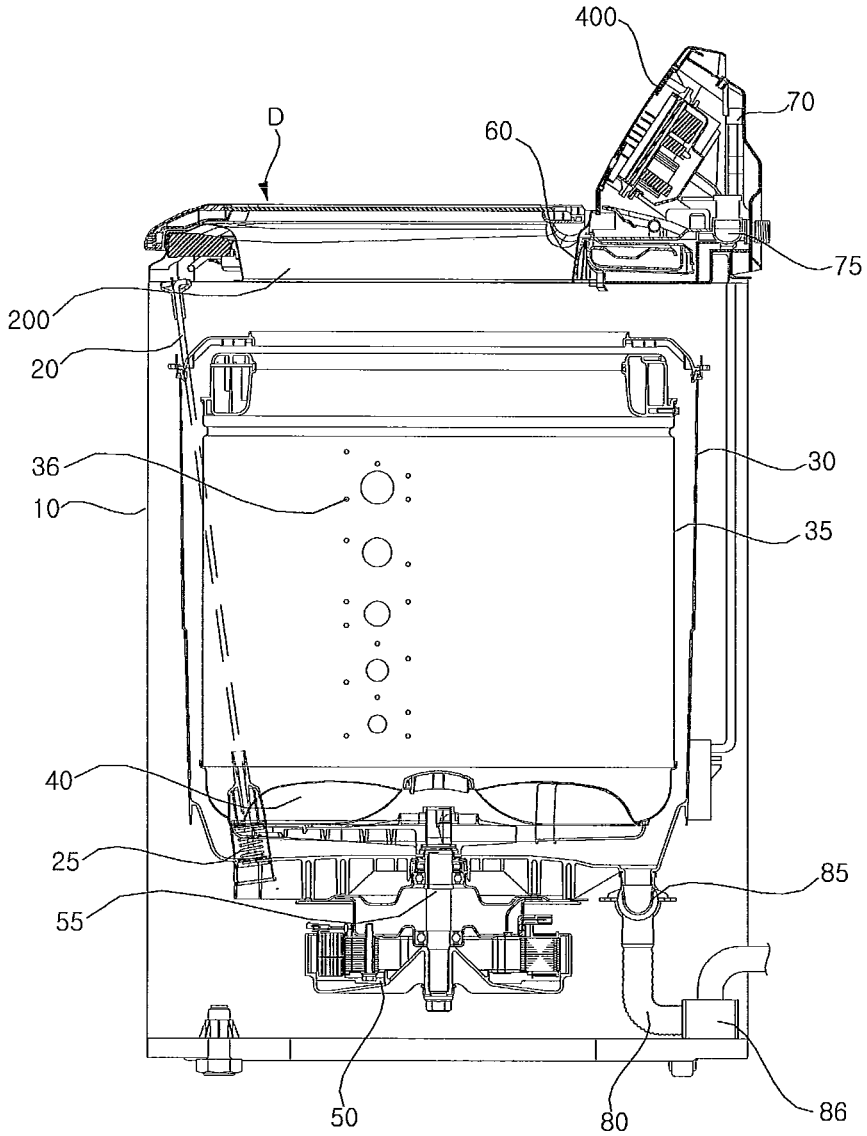
FIG. 2 is a side cross sectional view illustrating the washing machine shown in FIG. 1.
Figure 3:
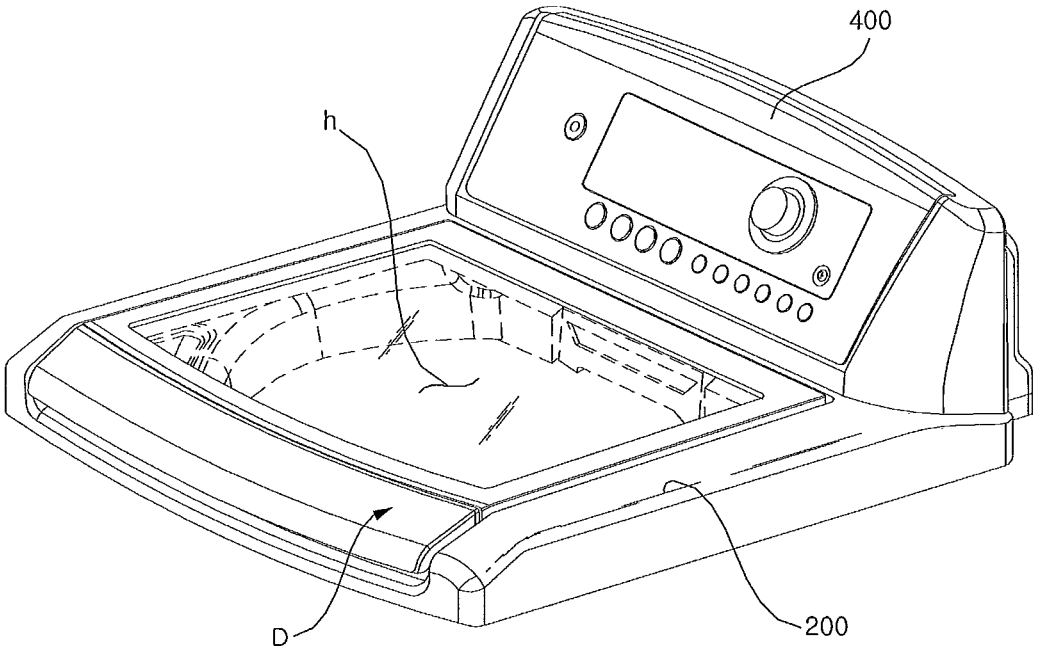
FIG. 3 is a perspective view illustrating part of the washing machine shown in FIG. 1.
Figure 4:
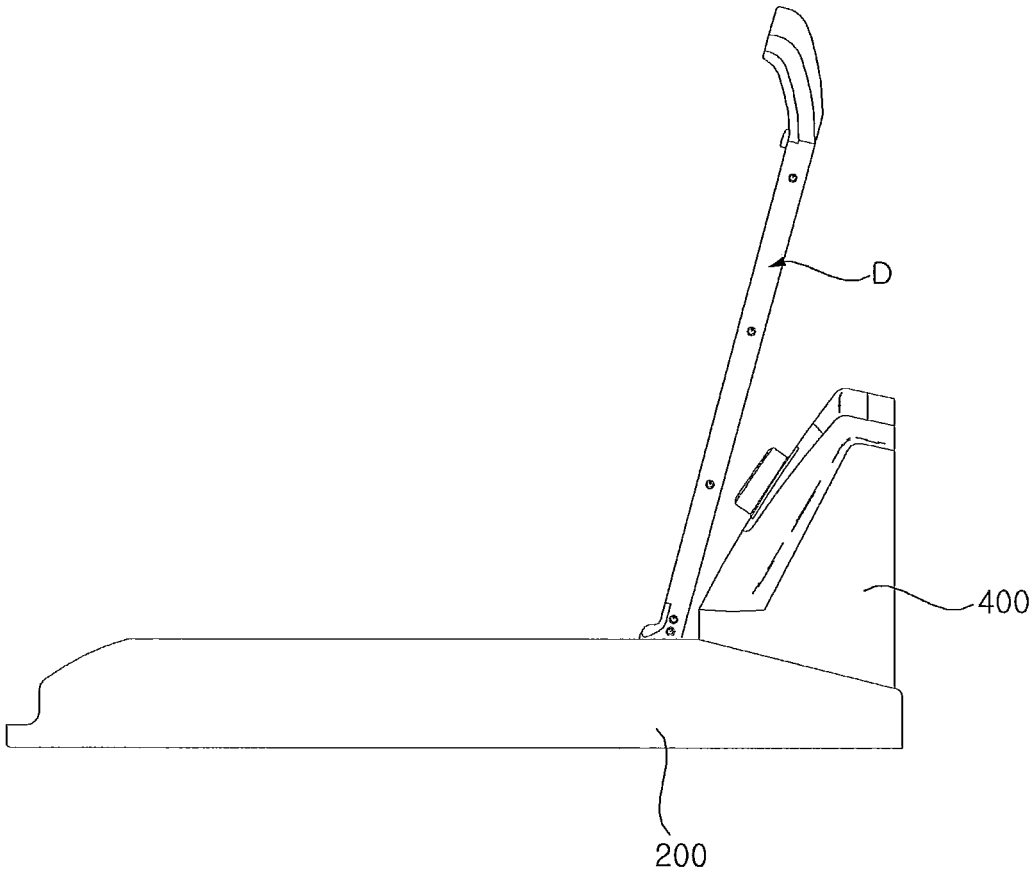
FIG. 4 is a side view illustrating a part shown in FIG. 3.
Figure 5:
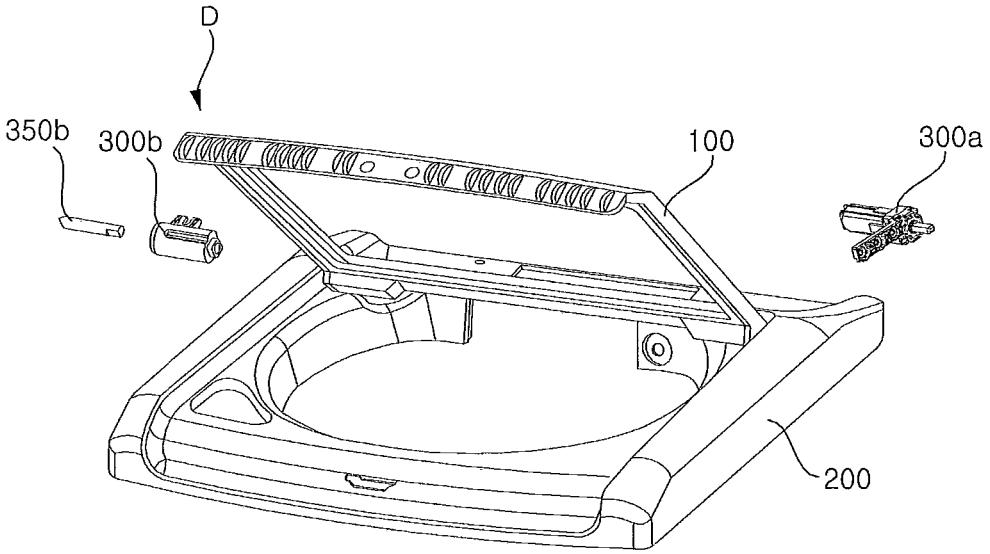
FIG. 5 is a perspective view illustrating a top cover, a lid assembly, a first hinge unit, and a second hinge unit.
Figure 6:
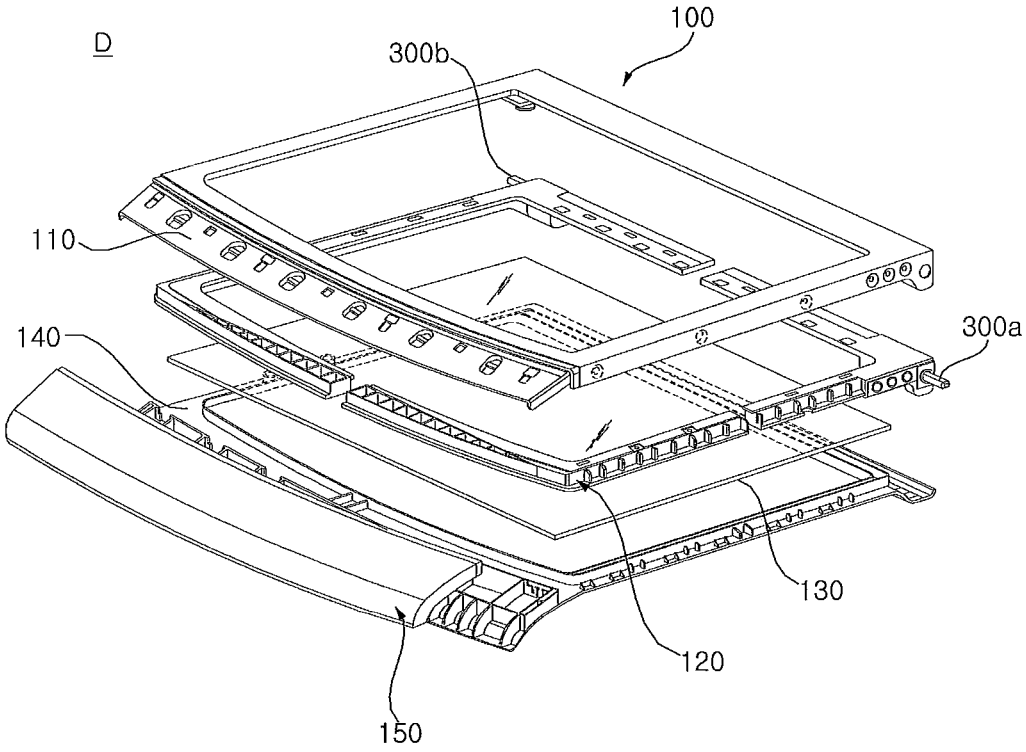
FIG. 6 is an exploded perspective view illustrating the lid assembly.
Figure 7:
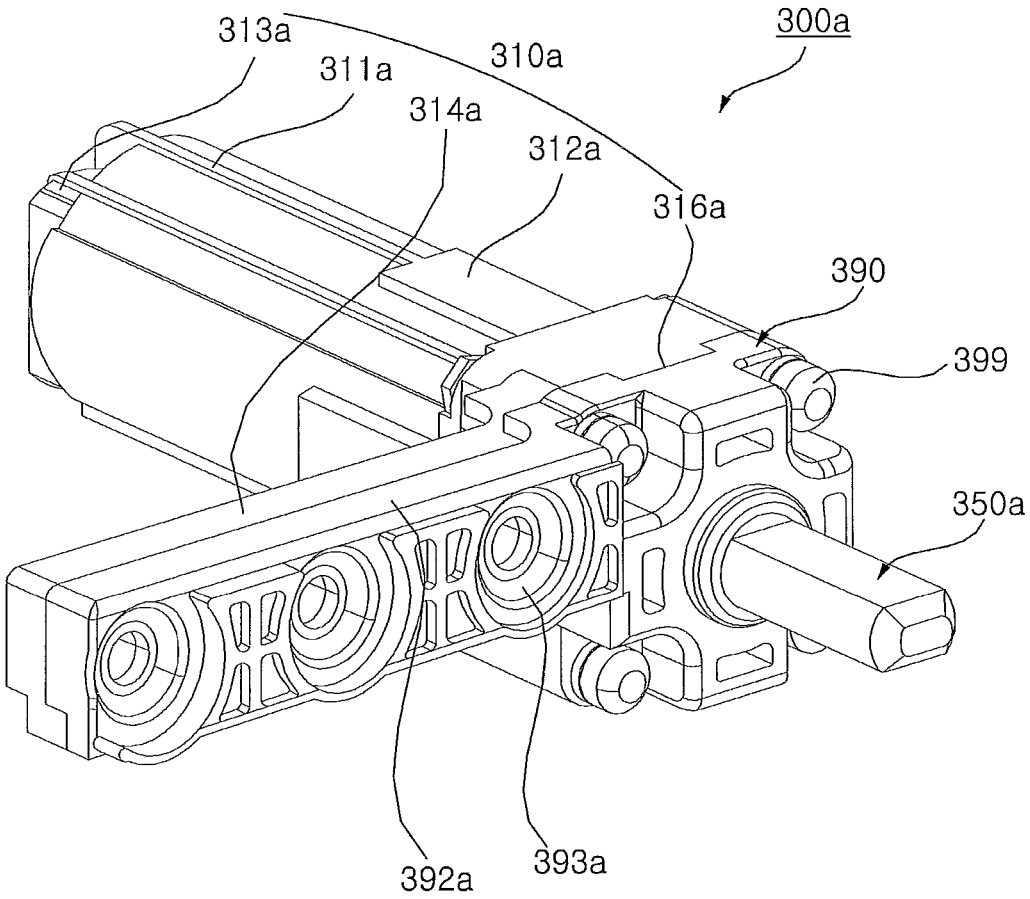
FIG. 7 is a perspective view illustrating the first hinge unit shown in FIG. 6.
Figure 8:
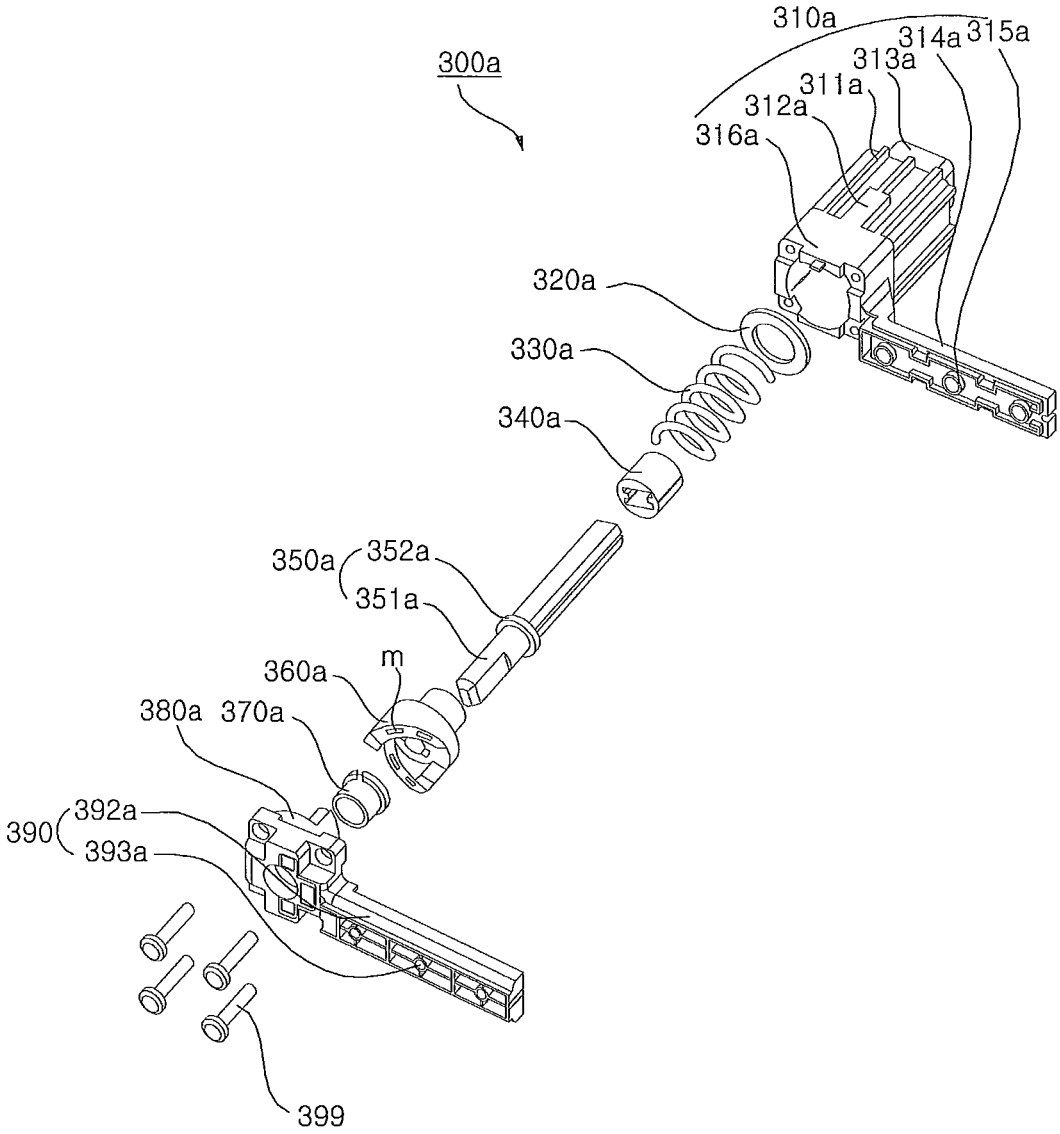
FIG. 8 is an exploded perspective view illustrating the first hinge unit shown in FIG. 7.

FIG. 1 is a perspective view illustrating a washing machine according to an embodiment of the present invention. FIG. 2 is a side cross sectional view illustrating the washing machine shown in FIG. 1. FIG. 3 is a perspective view illustrating part of the washing machine shown in FIG. 1. FIG. 4 is a side view illustrating a part shown in FIG. 3. FIG. 5 is a perspective view illustrating a top cover, a lid assembly, a first hinge unit, and a second hinge unit. FIG. 6 is an exploded perspective view illustrating the lid assembly shown in FIG. 6. FIG. 7 is a perspective view illustrating the first hinge unit shown in FIG. 6. FIG. 8 is an exploded perspective view illustrating the first hinge unit shown in FIG. 7.

Referring to FIGS. 1 to 8, the washing machine W includes a cabinet 10 of which an upper portion is open, a top cover 200 positioned at the upper portion of the cabinet 10 and includes an opening h for loading and unloading laundry, a door unit D that is rotatably coupled to the top cover 200 to open and close the opening h, and a control panel 400 that includes an interface allowing a user to control the washing machine W.

An outer tub 30 is supported by a supporting member 20 in the cabinet 10 to contain wash water. An inner tub 35 is rotatably positioned in the outer tub 30. A suspension 25 is provided at a lower end of the supporting member 20 to mitigate sway of the outer tub 30 which is caused by vibration occurring while the inner tub 35 is rotated. A pulsator 40 is rotatably positioned at a bottom portion of the inner tub 35. Contaminants may be removed from the laundry by a frictional action between the pulsator 40 and wash water contained in the inner tub 35 and a water current generated by rotation of the pulsator 40.

A plurality of water pores 36 are formed on the inner tub 35 so that the wash water may flow between the outer tub 30 and the inner tub 35. A motor 50 is provided at a lower side of the outer tub 30 to rotate the inner tub 35 and the pulsator 40. The inner tub 35 and/or the pulsator 40 may be rotated by driving shaft 55 of the motor 50.

A clutch (not shown) couples the driving shaft 55 with the inner tub 35 and/or the pulsator 40 to simultaneously rotate the inner tub 35 and the pulsator 40 or selectively rotate one of the inner tub 35 and the pulsator 40.

A detergent box 60 is detachably provided at the top cover 200 to contain a detergent. The top cover 200 includes a water supply hose 70 that is connected to an external water source (not shown) via, for example, a tab (not shown) to supply wash water to the detergent box 60, and a water supply valve 75 that opens and closes wash water supplied through the water supply hose 70. When the water supply valve 75 is opened, wash water from an external water source is flowed in the detergent box 60 and mixed with the detergent contained in the detergent box 60, and then the mixed water is supplied to the inner tub 35.

A drainage hose 80 for discharging wash water from the outer tub 30 to the exterior, a drainage valve 85 for opening and closing wash water discharged through the drainage hose 80, and a drainage pump 86 for pumping wash water to the exterior are provided at a lower end of the outer tub 30.

The door unit D includes a lid assembly 100 and a first hinge unit 300*a*. The lid assembly 100 is rotatably coupled to the top cover 200 to allow a user to open and close the opening h. The first hinge unit 300*a* connects the lid assembly 100 with the top cover 200. A front end of the lid assembly 100 may protrude forwards more than the top cover 200 while the lid assembly 100 is left closed to facilitate opening of the lid assembly 100.

The lid assembly 100 includes a lid upper frame 110, a lid inner 120, a transparent element 130, a lid lower frame 140, and a decorative panel 150.

The lid upper frame 110 forms the appearance of an upper portion of the lid assembly 100, and the lid lower frame 140 forms the appearance of a lower portion of the lid assembly 100. The lid inner 120 is provided between the lid upper frame 110 and the lid lower frame 140 to increase rigidity of the lid assembly 100, thus preventing the lid assembly 100 from being deformed, and to install the transparent element 130.

The lid upper frame 110 and the lid lower frame 140 are open at a central portion thereof so that laundry can be viewed from the outside. The lid inner 120 is formed along a periphery of the lid assembly 100 to surround and fix the transparent element 130.

A lid inner may be formed as a single body. Also, a plurality of lid inners may be provided. According to an embodiment, for example, four lid inners 120 may be provided as shown in FIG. 6, wherein each of the lid inners 120 is positioned near a corner of the lid assembly 100 to fix the corner of the lid assembly 100.

The lid inners 120 are positioned between the lid upper frame 110 and the lid lower frame 140 and surround the transparent element 130. Accordingly, the lid inners 120 are arranged between the transparent element 130 and the lid upper frame 110. The lid inners 120 may have a proper tolerance corresponding to the shape of the transparent element 130 so that the transparent element 130 may be fixed without sway.

For example, the lid inners 120 may be formed of a plastic molded body to have slight elasticity. The transparent element 130 surrounded by the lid inners 120 is tightly fitted in the lid upper frame 110 due to an externally exerted force, thereby fixing the transparent element 130 without sway. As a consequence, the lid assembly 100 may be increased.

The transparent element 130 is a window that is formed of a transparent material to allow a user to view the laundry in the inner tub 35 of the washing machine W through the transparent element 130. According to an embodiment, the transparent element 130 may be formed of transparent plastic or reinforced glass that ensures a sufficient strength against an external force or scratches.

An upper end of the decorative panel 150 is coupled to a front end of the lid upper frame 110, and a lower end of the decorative panel 150 is coupled to the lid lower frame 140, thereby defining a handle that may be held by a user to rotate the lid assembly 100. The decorative panel 150 may reinforce coupling of the lid upper frame 110 and the lid lower frame 140. Also, the decorative panel 150 prevents a coupled portion of the lid upper frame 110 and the lid lower frame 140 from being viewed from the outside, thus enhance aesthetic sense of the lid assembly 100.

The first hinge unit 300*a* couples the lid assembly 100 with the top cover 200 and reduces a speed of closing the lid assembly 100 in a predetermined section where the lid assembly 100 is closed.

The first hinge unit 300*a* includes an elastic member 330*a* and a cam unit that elastically deforms the elastic member 330*a* while the lid assembly 100 rotates and converts a restoring force exerted from the deformed elastic member 330*a* to a rotational force.

The elastic member 330*a* may be formed of various types of members that are deformed while the lid assembly 100 rotates to generate an elastic force or a restoring force. The elastic member 330*a* may be properly selected depending on characteristics, such as an installed location or structure. According to an embodiment, the elastic member may be a spring 330*a* that is compressed while the lid assembly 100 rotates.

The first hinge unit 300*a* may be provided at the lid assembly 100 or the top cover 200. For example, when the top cover 200 cannot ensure a sufficient space for the first hinge unit 300*a* due to the opening h, the first hinge unit 300*a* may be provided at the lid assembly 100.

The first hinge unit 300*a* may be connected to the lid assembly 100 by various structures. For example, according to an embodiment, the first hinge unit 300*a* may be mounted on the lid inner 120.

The door unit D may further include a second hinge unit 300*b*. An end of the lid assembly 100 is coupled to the top cover 200 by the first hinge unit 300*a*, and the other end of the lid assembly 100 is coupled to the top cover 200 by the second hinge unit 300*b*.

The first hinge unit 300*a* generates a torque in a direction of opening the lid assembly 100 in a predetermined section where the lid assembly 100 rotates. Such a torque allows a speed of closing the lid assembly 100 to be reduced while the lid assembly 100 is closed in the predetermined section, and allows the lid assembly 100 to be easily opened with less force while the lid assembly 100 is opened in the predetermined section.

The second hinge unit 300*b* serves to reduce rotation speed of the lid assembly 100 in various manners, such as, for example, using an oil pressure or a restoring characteristic of a coil spring. In this embodiment, the second hinge unit employs a method of using an oil pressure. However, the present invention is not limited thereto. For example, known various types of hinge units may be employed to reduce rotation speed.

In the present embodiment, the second hinge unit 300*b* is filled with a fluid and includes a rotation wing (not shown) sunk under the fluid and rotates in operative association with the lid assembly 100. When the lid assembly 100 rotates, repulsion, such as resistance or pressure, is exerted against the rotation wing by the fluid, thereby reducing the rotation speed of the lid assembly 100.

When the lid assembly 100 is not only rotated closed but also rotated opened, resistance of the second hinge unit 300*b* causes a predetermined torque to be generated against the rotation of the lid assembly 100.

In terms of stable rotation of the lid assembly 100, the second hinge unit 300*b* operates as a hydraulic damper to improve feel of operation while the lid assembly 100 rotates.

According to an embodiment, the first hinge unit 300*a* and the second hinge unit 300*b* may be in alignment with the rotation axis of the lid assembly 100.

The cam unit included in the first hinge unit 300*a* converts rotational movement of the lid assembly 100 to linear movement that allows the elastic member 330*a* to be elastically deformed.

Referring to FIGS. 7 and 8, the first hinge unit 300*a* includes a first hinge unit housing 310*a* that is inserted in the lid inner 120 and includes the cam unit therein and a first hinge unit housing cover 390 that is connected to the first hinge unit housing 310*a* by a coupling member, such as a screw or a bolt 399.

Connecting arms 314*a* and 392*a* are extended from the first hinge unit housing 310*a* and the first hinge unit housing cover 390, respectively. The connecting arms 314*a* and 392*a* are coupled to each other and then connected to the lid upper frame 110 by a coupling member, such as a screw.

The first hinge unit housing 310*a* includes a protruded and depressed surface 316*a* coupled to the first hinge unit housing cover 390 and protrusions 311*a*, 312*a*, and 313*a* that prevent the first hinge unit 300*a* from running idle in the lid inner 120. The lid inner 120 includes grooves to which the protrusions 311*a*, 312*a*, and 313*a* are inserted. The first hinge unit 300*a* is prevented from running idle in the lid inner 120 by inserting the protrusions 311*a*, 312*a*, and 313*a* into the grooves.

Coupling members, such as screws or bolts, are connected through the lid upper frame 110 to coupling holes 315*a* and 393*a* provided at the connecting arms 314*a* and 392*a* with the first hinge unit 300*a* inserted in the lid inner 120, so that the lid assembly 100 may be rotated in operative association with the first hinge unit 300*a*.

The cam unit of the first hinge unit 300*a* includes a rotational cam 380*a* operatively associated with the lid assembly 100 and a reciprocating cam 360*a* that is engaged with the rotational cam 380*a* to reciprocate along a shaft 350*a*. The shaft 350*a* is connected to a shaft bracket 240 provided at the top cover 200.

The shaft bracket 240 restricts rotation of the shaft 350*a*. For this purpose, the shaft 350*a* includes a chamfer 351*a* along a longitudinal direction, and the shaft bracket 240 includes a shaft support hole 243 that has a cross-sectional shape corresponding to a cross-sectional shape of the shaft 350*a* having the chamfer 351*a*.

The shape of the reciprocating cam 360*a* corresponds to the shape of the rotational cam 380*a*. The reciprocating cam 360*a* and the rotational cam 380*a* are formed to be inclined along a circumferential direction so that the height of a portion where the reciprocating cam 360*a* and the rotational cam 380*a* are come in contact with each other is changed. In a structure where the reciprocating cam 360*a* and the rotational cam 380*a* are engaged to each other, a surface of the rotational cam 380*a*, which abutting the reciprocating cam 360*a* converts rotational movement of the rotational cam 380*a* to linear movement to let the reciprocating cam 360*a* reciprocate. Such a surface is hereinafter defined as a "conversion surface m". A profile of a slope of the conversion surface m as viewed from a side surface is defined as a "conversion line s".

Further, a surface of the reciprocating cam 360*a* abutting the conversion surface m of the rotational cam 380*a* allows the reciprocating cam 360*a* to reciprocate along the shaft 350*a* to exert a force against the conversion surface m. Such a surface is defined as an "acting surface".

Although it has been described in this embodiment that the rotational cam 380*a* and the reciprocating cam 360*a* have the same shape, that is, the profile of the conversion surface of the rotational cam 380*a* is identical to the profile of the acting surface of the reciprocating cam 360*a*, the present invention is not limited thereto. For example, the shape of the conversion surface and the acting surface does not matter as long as the conversion surface is formed on the rotational cam 380*a* and, corresponding to the profile of the conversion surface, the acting surface is formed on the reciprocating cam 360*a* such that the reciprocating cam 360*a* may reciprocate in a certain distance as the rotational cam 380*a* rotates.

Similarly, the acting surface may be formed on the reciprocating cam 360*a*, and, corresponding to the profile of the acting surface, the conversion surface may be formed on the rotational cam 380*a* to convert a force exerted from the acting surface of the reciprocating cam 360*a* so that the rotational cam 380*a* may rotate.

An embodiment will now be described where the conversion surface m of the rotational cam 380*a* and the acting surface of the reciprocating cam 360*a* are formed identical to each other. The description will primarily focus on the conversion surface m and the conversion line s formed on the rotational cam 380*a*.

While the lid assembly 100 rotates, the conversion surface m of the rotational cam 380*a* rotatively slides along the acting surface of the reciprocating cam 360*a* and is subjected to a force exerted from the acting surface of the reciprocating cam 360*a*. The direction of the force is changed by the slope of the conversion surface m to generate a torque.

The moving distance of the reciprocating cam 360*a* varies with rotational angle of the rotational cam 380*a*. The slope of the conversion surface m may be set in consideration with, for example, the moving distance of the reciprocating cam 360*a*. Since the moving distance of the reciprocating cam 360*a* is equal to the compressed length of the spring 330*a*, it can be said that the slope of the conversion surface m is closely associated with a torque exerted by the first hinge unit 300*a*.

In this embodiment, the cam unit includes the shaft 350*a*, the rotational cam 380*a*, and the reciprocating cam 360*a*. The reciprocating cam 360*a* starts to reciprocate along the shaft 350*a* by a repulsive force exerted from the rotational cam 380*a* as the lid assembly 100 rotates. In this situation, as described above, the elastic member 330*a* connected to the shaft 350*a* is elastically deformed. Further, a restoring force of the deformed elastic member 330*a* is converted to a rotational force by the cam unit, thereby generating a torque.

Accordingly, as the lid assembly 100 rotates, the cam unit converts rotational movement of the rotational cam 380*a* to linear movement of the reciprocating cam 360*a* and vice versa by interaction between the rotational cam 380*a* and the reciprocating cam 360*a*.

The first hinge unit 300*a* may further include a washer 320*a* inserted between the spring 330*a* and the first hinge unit housing 310*a*, a bush 340*a* connected to the shaft 350*a*, and a bush 370*a* inserted in the first hinge unit housing cover 390 to support the shaft 350*a*.

As the rotational cam 380*a* rotates, the reciprocating cam 360*a* linearly reciprocates while inserted in the shaft 350*a*, and the spring 330*a* is extended or compressed by the reciprocating cam 360*a*. The shaft 350*a* includes a stepped portion 352*a* that restricts the moving distance of the reciprocating cam 360*a*.

Figure 9A:
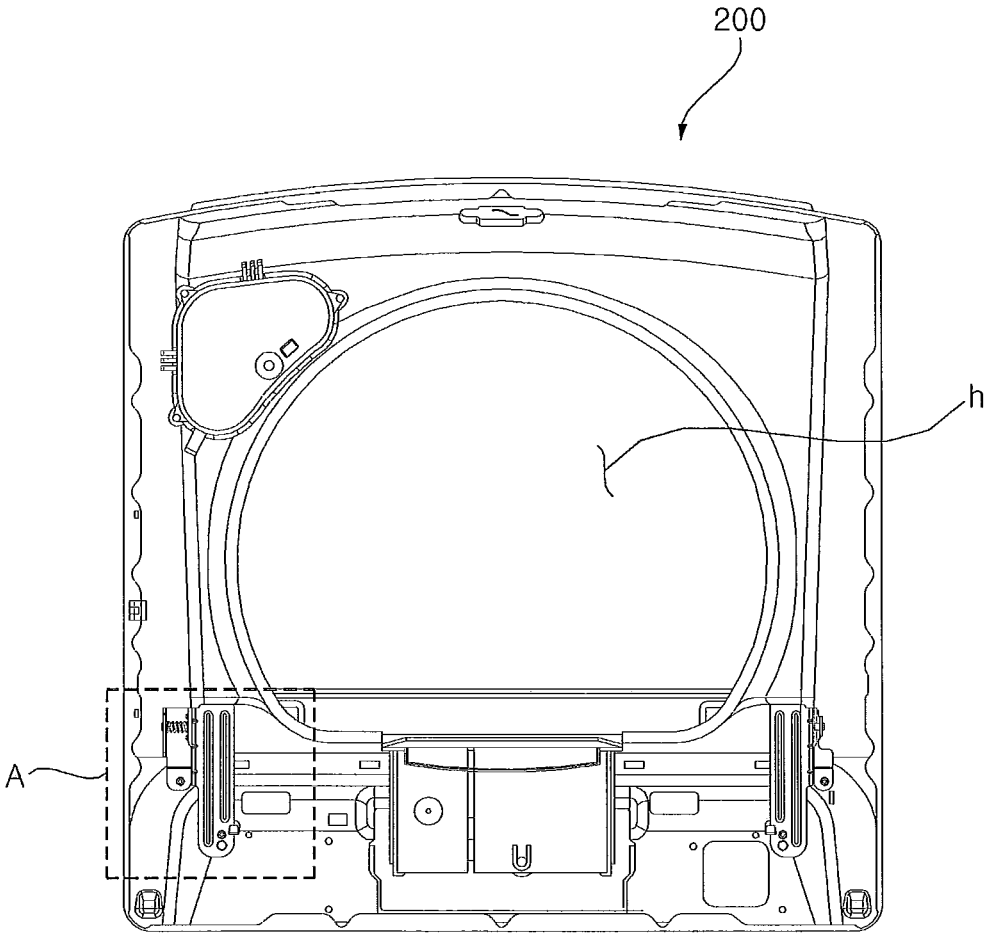
FIG. 9A is a view illustrating a structure where a shaft bracket is connected to a lower surface of the top cover to fix a shaft connected to a second hinge unit so that the shaft does not rotate.
Figure 9B:
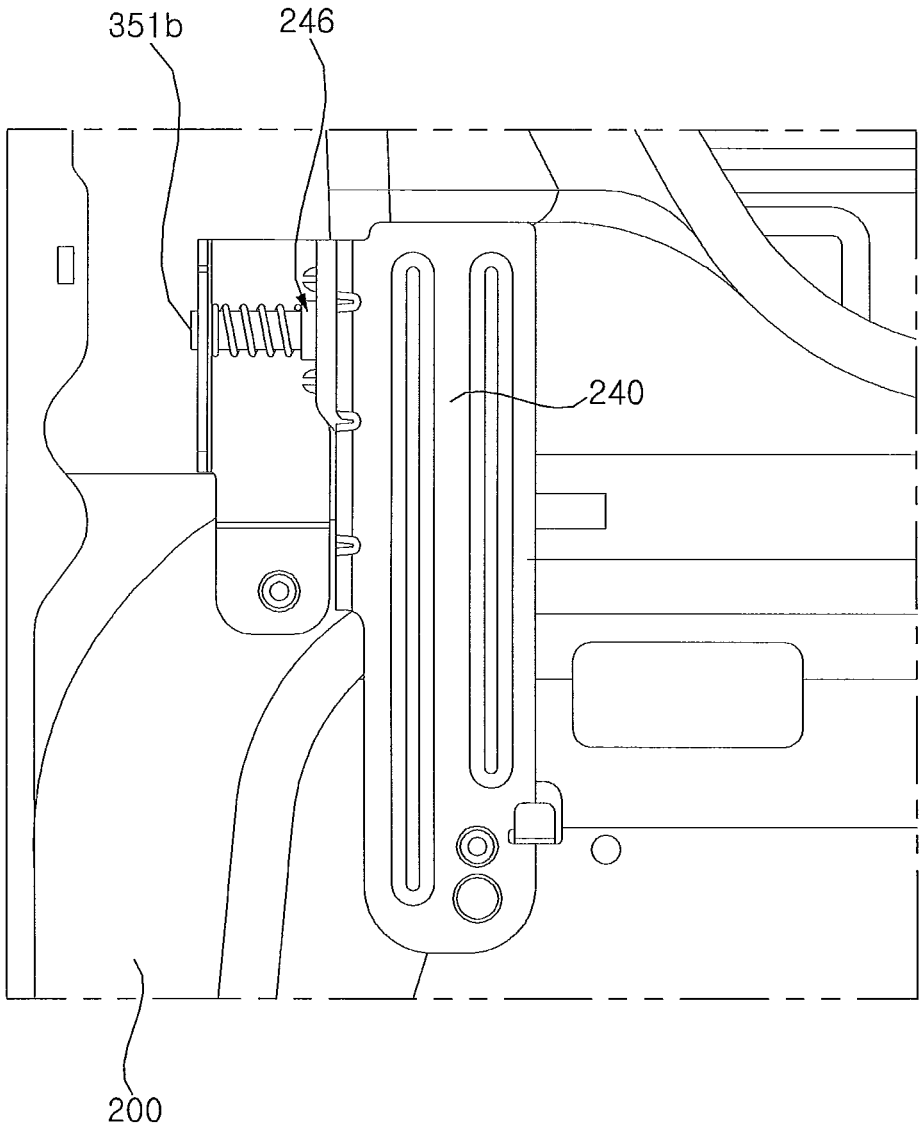
FIG. 9B is an expanded view of part A shown in FIG. 9A.
Figure 10:
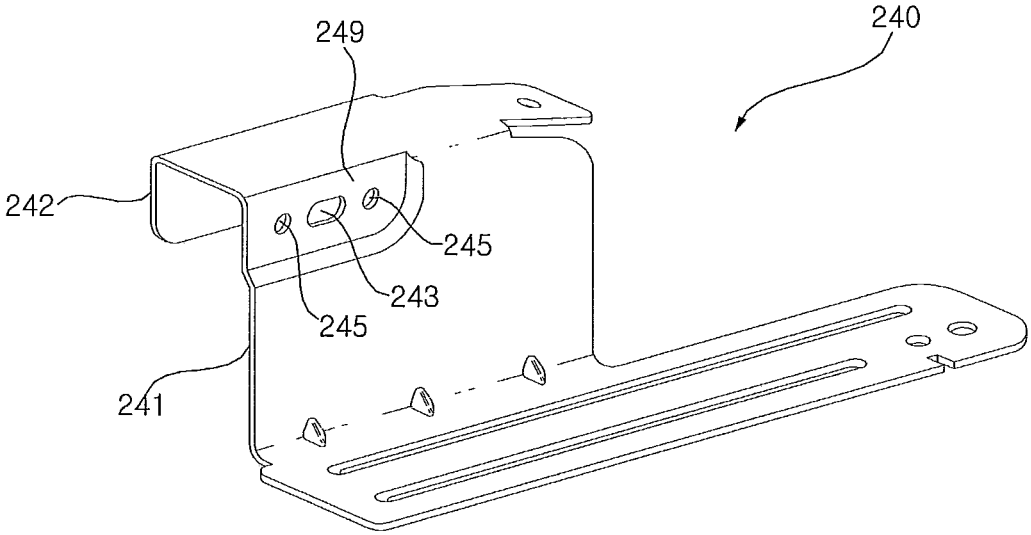
FIG. 10 is a perspective view illustrating the shaft bracket shown in FIG. 9A.

FIG. 9A is a view illustrating a structure where a shaft bracket is connected to a lower surface of the top cover to fix a shaft connected to a second hinge unit so that the shaft does not rotate. FIG. 9B is an expanded view of part A shown in FIG. 9A. FIG. 10 is a perspective view illustrating the shaft bracket shown in FIG. 9A.

Referring to FIGS. 9A, 9B, and 10, a shaft bracket 240 is fixed at a lower surface of the top cover 200 to support the shaft 350*b* connected to the second hinge unit 300*b*. To support the shaft 350*a* of the first hinge unit 300*a*, the shaft bracket 240 may also be provided at a side where the first hinge unit 300*a* is installed.

Although the shaft bracket 240 for supporting the shaft 350*b* connected to the second hinge unit 300*b* is shown in FIGS. 9A, 9B, and 10, the same structure may also be employed to support the shaft 350*a* of the first hinge unit 300*a*. An embodiment will now be described where the shaft bracket 240 supports the shaft 350*a* of the first hinge unit 300*a*.

The shaft bracket 240 supports the shaft 350*a* of the first hinge unit 300*a* at least two spots. For example, the shaft bracket 240 includes a first support 241 and a second support 242, which are spaced apart from each other, to support the shaft 350*a* at two spots.

The first support 241 and the second support 242 include a shaft support hole 243 that supports the shaft 350*a*. The shaft support hole 243 of the first support 241 may have the same shape as that of the shaft support hole 243 of the second support 242.

As such, the shaft 350*a* is supported by the shaft bracket 240 at two spots. Accordingly, even when a force is exerted to the shaft 350*a* as the lid assembly 100 rotates, the shaft 350*a* is aligned on a predetermined axis by the two shaft support holes 243. Thus, the shaft 350*a* may be stably supported without sway, thus improving feel of operation of the lid assembly 100.

The shaft 350*a* includes a chamfer 351*a* formed by substantially flatly cutting the shaft 350*a* along an axial direction to prevent the shaft 350*a* from rotating while inserted in the shaft support hole 243. The shaft support hole 243 has a shape corresponding to a shape of the shaft 350*a*. However, the present invention is not limited thereto. Any structures may be employed by one of ordinary skill to prevent rotation of the shaft 350*a*.

The bush 246 is inserted in the shaft bracket 240. The bush 246 is a shock absorbing member that is inserted between the shaft 350*a* and the shaft bracket 240. The bush 246 is formed of a slightly elastic material, such as, for example, plastic, to prevent the shaft 350*a* and the shaft bracket 240 from being worn due to friction between the shaft 350*a* and the shaft bracket 240. The shaft bracket 240 includes a connecting hole 245 to which the bush 246 is connected.

Figure 11:
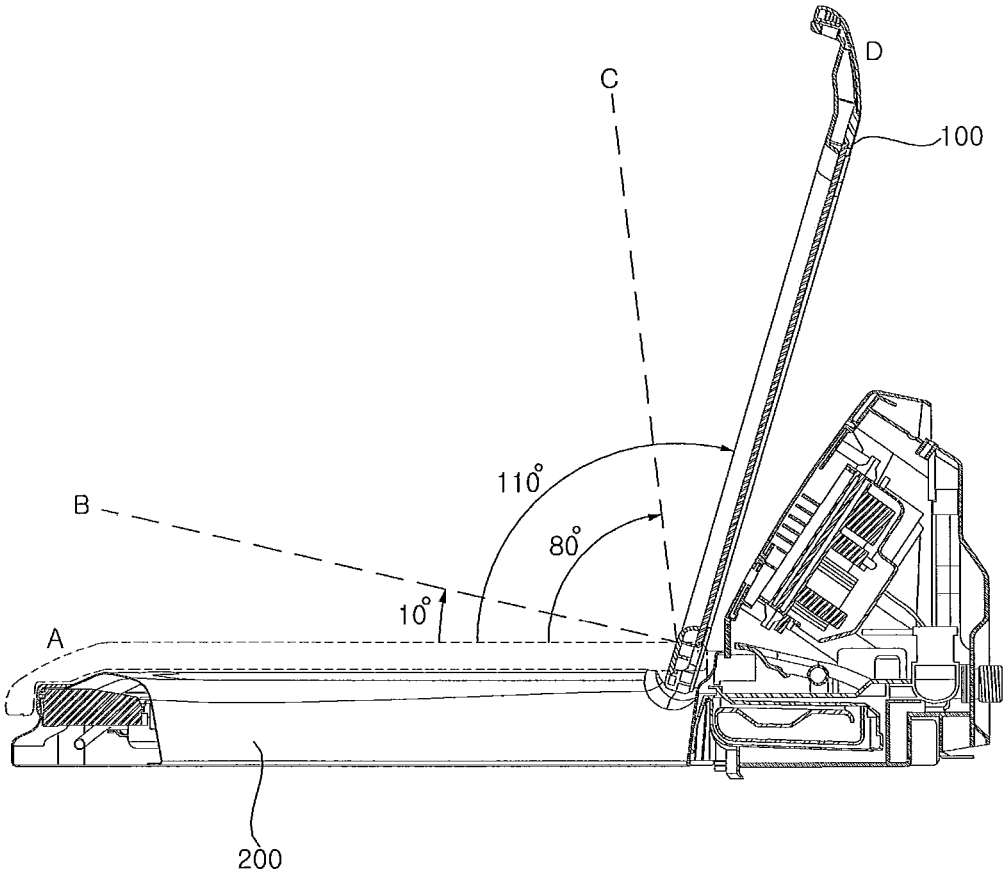
FIG. 11 is a side view illustrating rotational movement of a lid assembly.
Figure 12:
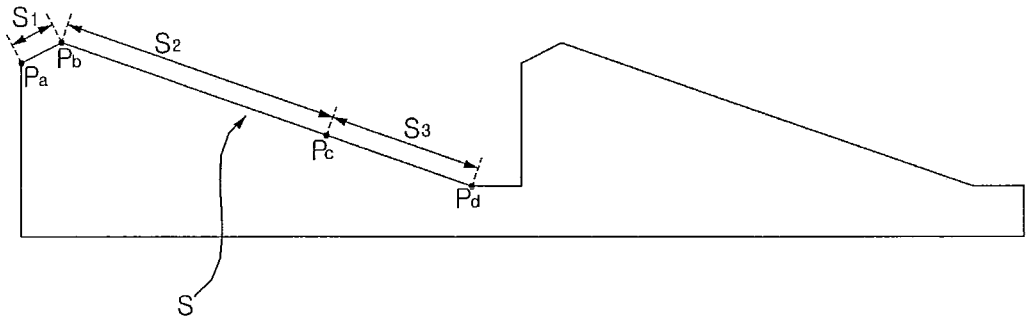
FIG. 12 is a view illustrating a profile obtained by expanding the rotational cam of the first hinge unit.
Figure 13:
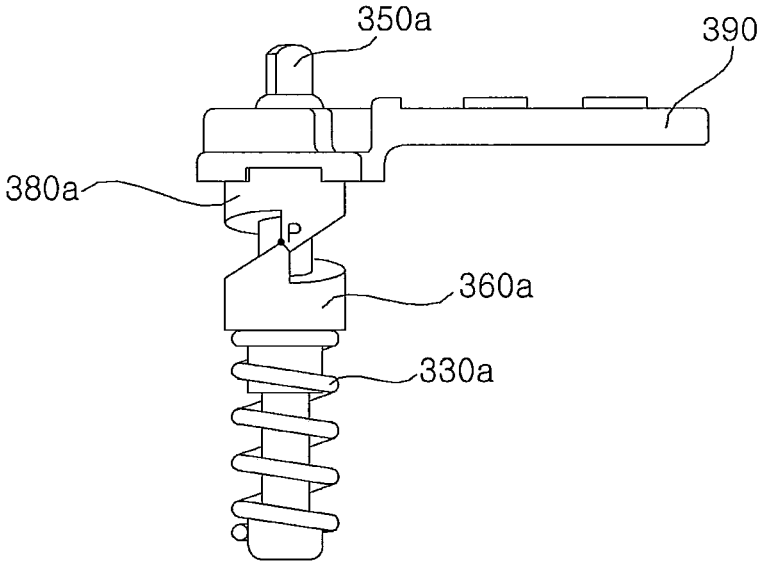
FIG. 13 is a view illustrating a relationship between the reciprocating cam and the rotational cam when the lid assembly of FIG. 11 is positioned at point A.
Figure 14:
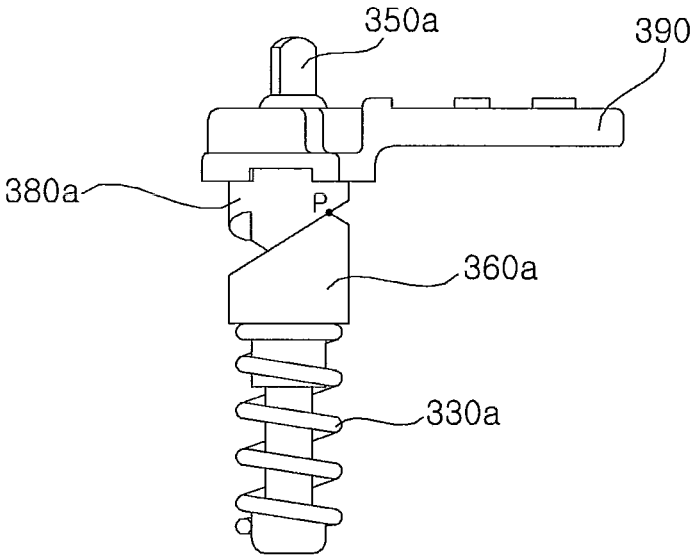
FIG. 14 is a view illustrating a relationship between the reciprocating cam and the rotational cam when the lid assembly of FIG. 11 is positioned between points B and position D.
Figure 15:
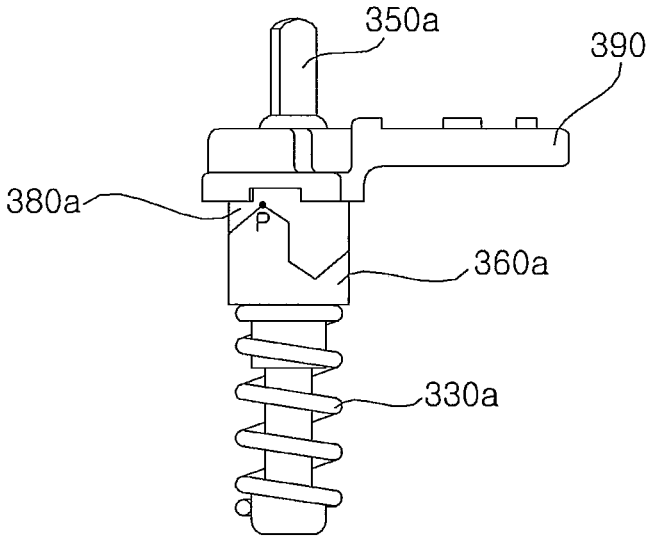
FIG. 15 is a view illustrating a relationship between the reciprocating cam and the rotational cam when the lid assembly of FIG. 11 is positioned at point D.

FIG. 11 is a side view illustrating rotational movement of a lid assembly. FIG. 12 is a view illustrating a profile obtained by expanding the rotational cam of the first hinge unit. FIG. 13 is a view illustrating a relationship between the reciprocating cam and the rotational cam when the lid assembly of FIG. 11 is positioned at point A. FIG. 14 is a view illustrating a relationship between the reciprocating cam and the rotational cam when the lid assembly of FIG. 11 is positioned between points B and position D. FIG. 15 is a view illustrating a relationship between the reciprocating cam and the rotational cam when the lid assembly of FIG. 11 is positioned at point D.

A process of opening the lid assembly 100 will now be described.

Referring to FIG. 11, the first hinge unit 300*a* generates a torque in a direction of opening the lid assembly 100 while the lid assembly 100 rotates between positions B and D so that a user may open the lid assembly 100 with less force. The rotational cam 380*a* of the first hinge unit 300*a* has a profile as shown in FIG. 12.

When point P of the reciprocating cam 360*a* (refer to FIGS. 13 to 15) is positioned in a section between points Pb and Pd, the reciprocating cam 360*a* exerts a force to the rotational cam 380*a* in an axial direction due to a restoring force of the compressed spring 330*a*, and the exerted force is converted to a rotational force by the converting surface m inclinedly formed on the rotational cam 380*a*. Accordingly, a torque is generated in a direction of opening the lid assembly 100, so that a user may open the lid assembly 100 with less force.

The resultant torque T exerted to the lid assembly 100 is equal to sum of a torque Tg generated by weight of the lid assembly 100, a torque Ts generated by the first hinge unit 300*a*, and a torque Td generated by the second hinge unit 300*b*. When the lid assembly 100 is positioned in a first section between points B and C, the torque Ts is exerted in the direction of opening the lid assembly 100, but the resultant torque T is still exerted in the direction of closing the lid assembly 100. That is, $T=Tg-Ts-Td>0$. "$T>0$" means the torque is exerted in the direction of closing the lid assembly 100, and "$T<0$" means the torque is exerted in the direction of opening the lid assembly 100. Here, "Tg", "Ts", and "Td" represent the magnitude of the torques, "+" represents a torque is exerted in the direction of closing the lid assembly 100, and "−" represents a torque is exerted in the direction of opening the lid assembly 100.

When the lid assembly 100 is positioned in a second section between points C and D, $T=Tg-Ts-Td<0$. Thus, the lid assembly 100 may be opened without external force.

Specifically, since $T>0$ in the first section between points B and C, an additional force is needed by a user to open the lid assembly 100. $T<0$ since point C is passed. Accordingly, in the second section between points C and D, the lid assembly 100 may automatically rotate up to point D with no additional force by the user. That is, in the first section with respect to point C, the lid assembly 100 is automatically closed, and thus, an additional force is needed to open the lid assembly 100. In this case, however, the lid assembly 100 may be opened with less force thanks to the torque Ts exerted in the direction of opening the lid assembly 100. And, the lid assembly 100 may be automatically closed without an additional force in the second section between points C and D.

A process of closing the lid assembly 100 will now be described.

The lid assembly 100 is left opened at point D. Then, a user exerts a force to the lid assembly 100 so that the lid assembly 100 is positioned at point C. Since position C is passed, $T>0$, and thus, the lid assembly 100 automatically rotates with no additional force in the direction of closing the lid assembly 100. In the first section between points C and B, the torques Ts and Td are exerted by the first hinge unit 300*a* and the second hinge unit 300*b* in the direction of opening the lid assembly 100. Therefore, the rotation speed of the lid assembly 100 is reduced to prevent the lid assembly 100 from excessively impacting the top cover 200.

Since the lid assembly 100 passes point B, i.e., while the lid assembly 100 is positioned in the third section between points B and A, point P is positioned in section S1 which is inclined in opposite direction from section S2, and thus, the torque Ts is exerted in the direction of closing the lid assembly 100, thereby closing the lid assembly 100 more securely ($T>0$).

In summary, when the lid assembly 100 is closed, in the first section between C and B, the rotation speed of the lid assembly 100 is reduced by the torques Ts and Td which are exerted in the direction of opening the lid assembly 100. In the third section between B and A, the torque Ts is exerted in the direction of closing the lid assembly 100 due to the slope of section S1, and thus, the closing speed is increased. Accordingly, the lid assembly 100 may be securely closed. In this case, since the open angle at point B where the acting direction of the torque Ts exerted to the lid assembly 100 is changed (Hereinafter, the "open angle" is referred to as an angle measured in the direction of opening the to lid assembly 100. The open angle is assumed as "0" degrees when the lid assembly 100 is closed) is an angle by which the rotation speed of the lid assembly 100 starts to be accelerated, the open angle will now be defined as an "accelerated closing reference angle". Although the accelerated closing reference angle is set as 10 degrees, the present invention is not limited thereto.

In the washing machine W according to an embodiment of the present invention, the lid assembly 100 is automatically opened or closed with respect to point C. Hereinafter, an open angle when the lid assembly 100 is positioned at point C is referred to as an "automatic opening reference angle" in terms of a process of opening the lid assembly 100 and as an "automatic closing reference angle" in terms of a process of closing the lid assembly 100.

Although the automatic opening/closing reference angle is 80 degrees as shown in FIG. 11, the present invention is not limited thereto. For example, the automatic opening/closing reference angle may include various angles, such as an open angle not more than 90 degrees.

The accelerated closing reference angle and/or automatic opening/closing reference angle may be properly set in consideration with convenience of use and durability. For example, weight of the lid assembly 100, and/or torque capacity of the first hinge unit 300*a* and the second hinge unit 300*b* may be further considered. Here, the "torque capacity" is defined as a range of torques that may be generated by the first hinge unit 300*a* or the second hinge unit 300*b*, that is, a range between the maximum torque and the minimum torque.

Torques generated by the first hinge unit 300*a* may vary within a predetermined range depending on a compressed length of the elastic member that changes as the lid assembly 100 rotates. The second hinge unit 300*b* may vary within a predetermined range depending on compressibility of the fluid that changes as the lid assembly 100 rotates.

Various ratios may exist between the torque capacity of the first hinge unit 300*a* and the torque capacity of the second hinge unit 300*b*.

When a ratio of the torque capacity of the first hinge unit 300*a* to the torque capacity of the second hinge unit 300*b* is 8:2, Ts becomes relatively larger than Td. Accordingly, the second section in which the lid assembly 100 is automatically opened may have a large range.

For example, when the ratio is 8:2, the lid assembly 100 may be automatically opened since the open angle of the lid assembly 100 arrives at 80 degrees.

When a ratio of the torque capacity of the first hinge unit 300*a* to to the torque capacity of the second hinge unit 300*b* is 7:3, a difference between Ts and Td is relatively small compared to when the ratio is 8:2. Accordingly, the second section is narrowed, and the first section is broadened. For example, the lid assembly 100 is automatically opened when the open angle is 85 or more degrees, and automatically closed when the open angle is 85 or less degrees.

Similarly, when a ratio of the torque capacity of the first hinge unit 300*a* to the torque capacity of the second hinge unit 300*b* is 6:4, the second section is further narrowed and the first section is broadened than when the ratio is 7:3. For example, the lid assembly 100 is automatically opened when the open angle is 90 or more degrees and automatically closed when the open angle is 90 or less.

The ranges of the first section and the second section depending on the torque capacity have been described assuming the weight of the lid assembly 100 is constant. However, as the weight of the lid assembly 100 varies, the torque Tg generated by the weight of the lid assembly 100 is changed. Accordingly, the first section and the second section vary as well. As a consequence, even when the ratio is 7:3 or 6:4, the lid assembly 100 may operate similarly to when the ratio is 8:2 by changing the weight of the lid assembly 100.

The first hinge unit 300*a* and the second hinge unit 300*b* may be designed so that a range of the torque capacity of the first hinge unit 300*a* and the torque capacity of the second hinge unit 300*b* has a proper value depending on the weight of the lid assembly 100. By doing so, the lid assembly 100 may be automatically opened or closed in the preset first and second sections.

For example, under a condition that the lid assembly 100 is automatically closed when the open angle ranges from 0 to 80 degrees and automatically opened when the open angle ranges from 80 to 110 degrees, when the weight of the lid assembly 100 is W1, a ratio of the torque capacity of the first hinge unit 300*a* to the torque capacity of the second hinge unit 300*b* may be designed to be 6:4. If the weight of the lid assembly 100 is changed from W1 to W2 larger than W1, the torque generated by the weight of the lid assembly 100 increases. Accordingly, the torque capacity of the first hinge unit 300*a* needs to be increased to automatically open the lid assembly 100 in the preset second section. In this case, a ratio of the torque capacity of the first hinge unit 300*a* to the torque capacity of the second hinge unit 300*b* may be 7:3 or 8:2.

In summary, the range of the first and second section may be determined depending on torque capacity of the first hinge unit 300*a* and the second hinge unit 300*b* and/or weight of the lid assembly 100. And, the lid assembly 100 may be adapted to be automatically opened/closed in the preset first and second sections by designing the first hinge unit 300*a* and the second hinge unit 300*b* such that a ratio of the torque capacity of the first hinge unit 300*a* and the torque capacity of the second hinge unit 300*b* has a proper value depending on the weight of the lid assembly 100.

The first hinge unit 300*a* may be adapted for the lid assembly 100 to be automatically closed when the open angle is not more than 60 degrees to improve convenience of use. For example, the first section may have an open angle of 60 to 80 degrees.

Further, the second section may have an open angle of 80 to 90 degrees so that the lid assembly 100 may be automatically opened even when the open angle is not more less 90 degrees.

The automatic opening/closing reference angle described above in connection with FIG. 11 is an angle of the lid assembly 100 when the lid assembly 100 is positioned at point C. For example, the automatic opening/closing reference angle may be substantially 80 degrees. This corresponds to a situation where P is positioned at Pc in FIG. 12.

The torque Ts generated by the first hinge unit 300*a* and the torque Td generated by the second hinge unit 300*b* may be selected as a proper value considering the torque Tg generated by the weight of the lid assembly 100. For example, Ts may be relatively larger than Td. Further, a proper ratio may be present between Ts and Td so that the lid assembly 100 may be automatically opened in the second section between C and D. For example, according to an embodiment, a ratio of Ts:Td may be substantially 8:2.

In the profile as shown in FIG. 12, the rotation of the lid assembly 100 is accelerated in section S1 to more securely close the lid assembly 100. Hereinafter, section S1 is referred to as an "accelerated closing control section". The slope of section S1 is referred to as an "(accelerated closing control slope". The rotation speed of the lid assembly 100 when the lid assembly 100 is rotated closed is reduced in section S2. Hereinafter, section S2 is referred to as a "closing speed reduction control section". The slope of section S2 is referred to as a "closing speed reduction control slope". In section S3, the lid assembly 100 is automatically opened without an additional force when the lid assembly 100 is rotated opened. Hereinafter, section S3 is referred to as an "automatic opening section". The slope of section S3 is referred to as an "automatic opening control slope".

In this embodiment, the conversion line S of the rotational cam 380*a* has been described to be a straight line. However, the present invention is not limited thereto. The conversion line S may be a curved line. Further, the conversion surface m may be formed to have various slopes in section S2 so that the degree of reducing the closing speed of the lid assembly 100 is varied, or the conversion surface m may be formed to have various slopes in section S3 so that the opening speed of the lid assembly 100 is varied within a section of automatically opening the lid assembly 100.

Further, except for section S1, the rotational cam 380*a* may be provided. In this case, when the lid assembly 100 has an angle equal to or less than the automated opening reference angle, the lid assembly 100 may be controlled so that the closing speed is reduced until the lid assembly 100 is fully closed. However, in any cases, the lid assembly 100 may be automatically opened or closed without user's force with respect to the automatic opening/closing reference angle. Further, the lid assembly 100 may be controlled so that the closing speed is reduced within a certain subsection of the closing section or the entire section.

Figure 16:
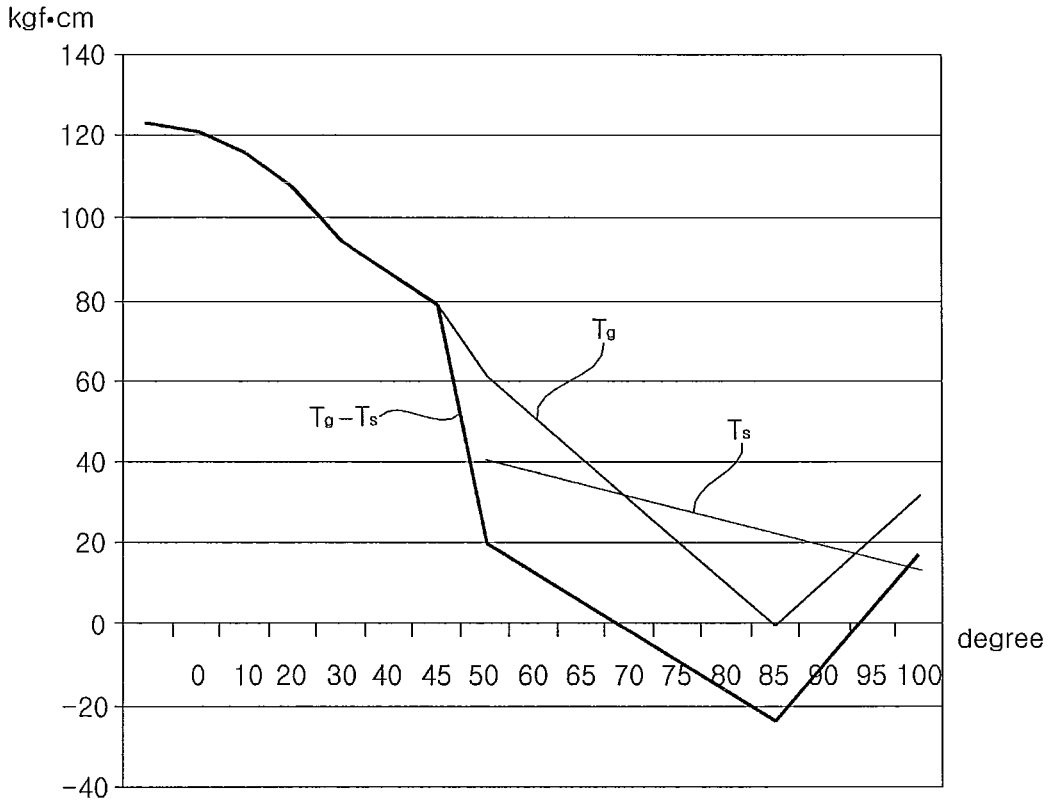
FIG. 16 is a graph illustrating torques generated according to rotational angles of the lid assembly.

FIG. 16 is a graph illustrating torques generated according to rotational angles of the lid assembly. Tg and Ts are only shown in FIG. 16 without considering an effect by the second hinge unit 300*b*. However, although the torque Td generated by the second hinge unit 300*b* is considered, the shape of the graph is substantially similar to that shown in FIG. 16.

Referring to FIGS. 11 and 16, as the lid assembly 100 is gradually opened and accordingly the open angle is increased, the torque Tg generated by the weight of the lid assembly 100 and the torque Ts generated by the first hinge unit 300*a* are exerted to the lid assembly 100. In the section where the open angle ranges from approximately 50 to 90 degrees, Tg is exerted in the direction of closing the lid assembly 100, and Ts is exerted in the direction of opening the lid assembly 100. At the point where the open angle is 80 degrees, Tg−Ts is −7.1 kgfcm.

According to an embodiment, under the condition that the lid assembly 100 rotates in the direction of closing the lid assembly 100 at an angle equal to or less than about 80 degrees and rotates in the direction of opening the lid assembly 100 at an angle equal to or more than about 80 degrees, a resultant torque exerted in the closing direction at an angle equal to or less than 80 degrees is minimized, and a resultant torque exerted in the opening direction at an angle equal to or more than 80 degrees is maximized, so that the closing speed of the lid assembly 100 is reduced when the lid assembly 100 is rotated closed and the opening speed of the lid assembly 100 is increased when the lid assembly 100 is rotated opened.

For this purpose, the second hinge unit 300*b* may be provided at a side of the lid assembly 100, wherein the second hinge unit 300*b* may have a proper torque capacity to satisfy the above condition. As an example, only when Td is exerted in the direction of opening the lid assembly 100 at an open angle of 80 degrees, or exerted in the direction of closing the lid assembly 100 with a value of less than 7.1 kgfcm, the total torque T exerted to the lid assembly 100 becomes negative, so that the lid assembly 100 may be automatically opened at an angle of 80 degrees or more.

Accordingly, the second hinge unit 310*b* according to an embodiment may be required to generate a torque enough to satisfy the condition that may automatically open or close the lid assembly 100 with respect to a predetermined angle (the above-mentioned automatic opening/closing reference angle, for example, 80 degrees in this embodiment).

Figure 17:
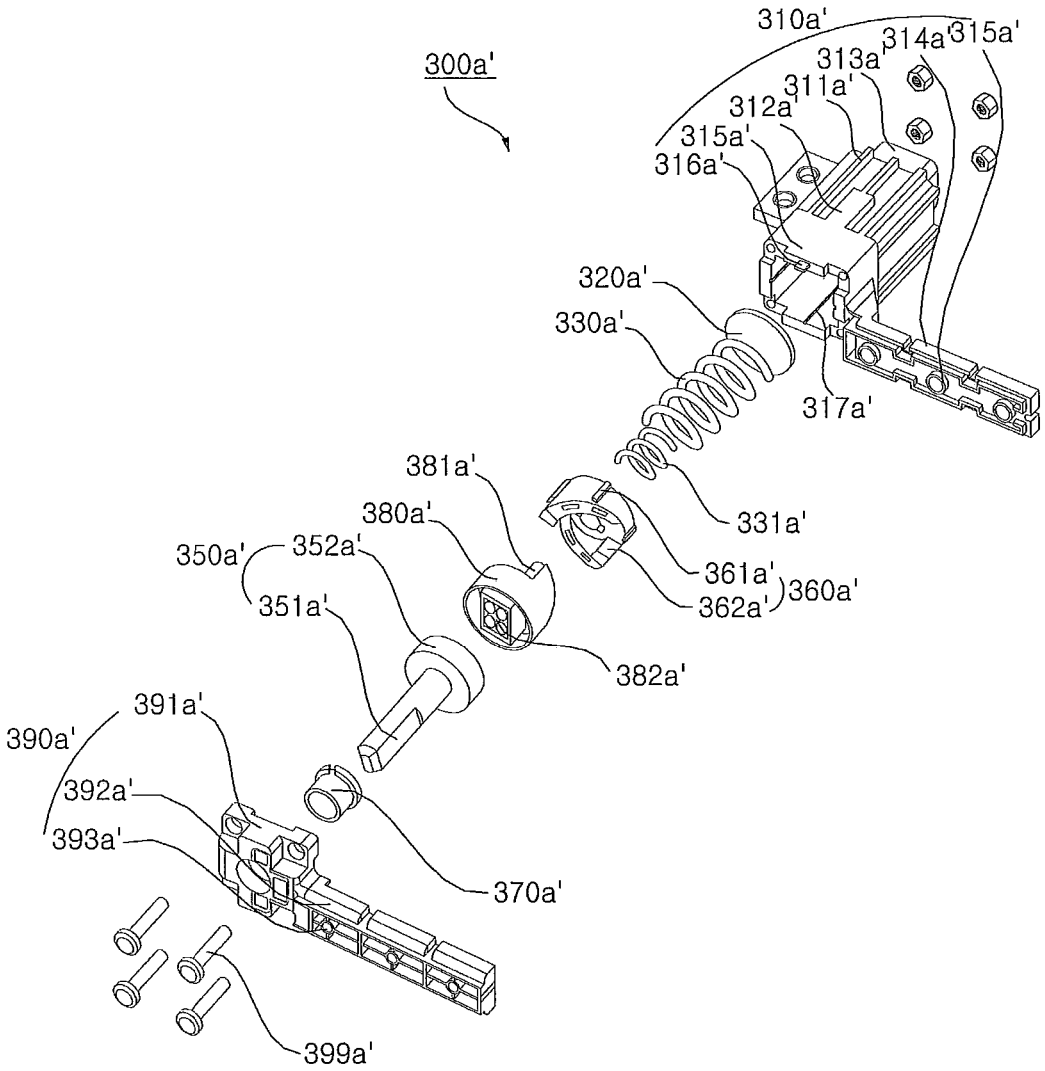
FIG. 17 is an exploded perspective view illustrating a first hinge unit 300*a*' according to other embodiment of the present invention.

FIG. 17 is an exploded perspective view illustrating a first hinge unit 300*a*' according to other embodiment of the present invention. The description on the same or similar constructions as the first hinge unit 300*a* described in connection with FIGS. 1-16 will not be repeated.

Referring to FIG. 17, the first hinge unit 300*a*' includes a cap unit that has a different structure from that of the first hinge unit 300*a*. The cam unit includes a fixing cam 380*a*' fixed so that the rotation thereof is restricted by a shaft 350*a*', a conversion cam 360*a*' that is engaged with the fixing cam 380*a*' to convert rotational movement to linear movement, and a spring that is compressed or extended by the reciprocating movement of the conversion cam 360*a*'. According to an embodiment, two springs 331*a*' and 330*a*' may be provided to generate a sufficient elastic force. The conversion cam 360*a*' includes a plurality of fixing protrusions 361*a*' along an outer circumferential surface and is inserted in a sliding groove 317*a*' provided along an inner circumferential surface of a first hinge unit housing 310*a*'. As the conversion cam 360*a*' rotates together with the first hinge unit 300*a*', the conversion cam 360*a*' is guided to reciprocate along the sliding groove 317*a*'. The springs 331*a*' and 330*a*' are inserted between the conversion cam 360*a*' and the first hinge unit housing 310*a*'.

The shaft 350*a*' includes a chamfer 351*a*' so that the rotation thereof is restricted when being coupled with the shaft bracket 240. The fixing cam 380*a*' includes a polygonal protruded and depressed part 382*a*' at a portion which is coupled to a connecting end 352*a*' of the shaft 350*a*'. A coupling part (not shown) is provided at the connecting end 352*a*' of the shaft 350*a*' to have a shape corresponding to a shape of the protruded and depressed part 382*a*' so that the fixing cam 380*a*' is not rotated.

The elements 310*a*', 311*a*', 312*a*', 313*a*', 314*a*', 315*a*', 316*a*', 390*a*', 392*a*', 393*a*', and 399*a*' have substantially the same constructions as those of the elements 310*a*, 311*a*, 312*a*, 313*a*, 314*a*, 315*a*, 316*a*, 390*a*, 392*a*, 393*a*, and 399*a*, respective, and thus, the description will not be repeated.

The operation of the hinge unit 300*a*' will now be described.

As the lid assembly 100 rotates, the conversion cam 360*a*' rotates accordingly. And, the conversion cam 360*a*' also reciprocates due to the shape of ends 381*a*' and 362*a*' of the fixing cam 380*a*' and the conversion cam 360*a*'.

When the lid assembly 100 is rotated closed, the conversion cam 360*a*' gradually slides in the first hinge unit housing 310*a*' to compress the springs 330*a*' and 331*a*'. On the contrary, when the lid assembly 100 is rotated opened, the conversion cam 360*a*' gradually slides out from the housing 310*a*' to restore the compressed springs 330*a*' and 331*a*'.

In the previous embodiment, a torque is exerted to the lid assembly 100 by the cam unit that includes the rotational cam 380*a* rotating along with the lid assembly 100, the reciprocating cam 360*a* that is connected to the shaft 350*a* in a manner of restricting the rotation and reciprocates as the rotational cam 380*a* rotates, and the spring 330*a* that is compressed and extended by the reciprocating cam 360*a*. On the contrary, in this embodiment, a torque is exerted to the lid assembly 100 by the cam unit that includes the fixing cam 380*a*' whose rotation is restricted, the conversion cam 360*a*' that rotates along with the lid assembly 100 and reciprocates by a force exerted from the fixing cam 380*a*', and the springs 330*a*' and 331*a*' that are compressed and extracted by the conversion cam 360*a*'.

In particular, in this embodiment, two springs, such as the first and second springs 330*a*' and 331*a*', are employed unlike the previous embodiment, wherein the first and second springs 330*a*' and 331*a*' are different in length and diameter from each other. The second spring 331*a*' has short diameter and length that those of the first spring 330*a*' to be inserted in the first spring 330*a*'. In such a dual spring structure, only the first spring 330*a*' is compressed and the closing speed of the lid assembly 100 is reduced in a section while the lid assembly 100 is closed, and then, after the section is passed, the second spring 331*a*' is compressed together with the first spring 330*a*' to further reduce the closing speed of the lid assembly 100.

The torque generated by the weight of the lid assembly 100 is gradually increased while the lid assembly 100 is closed and thus the closing speed may be abruptly increased. To reduce such an abrupt increase in closing speed, the second spring 331*a*' is additively provided in the first spring 330*a*'. Specifically, when the first spring 330*a*' is gradually compressed to reach an end of the second spring 331*a*' (for example, when the open angle is 20 degrees), the first and second springs 330*a*' and 331*a*' are together compressed to effectively reduce the closing speed of the lid assembly 100.

The operation of the lid assembly 100 after the first hinge unit 300*a*' is connected to the lid assembly 100 is substantially the same or similar as that described in the previous embodiment, and thus, the description will not be repeated.

The present invention may apply to any washing machines including a laundry washer, a drier, and a washer with a drier, and thus, the present invention is not limited to the washing machine described with reference to the drawings and specification.

In the washing machine according to an embodiment of the present invention, the speed of closing the lid assembly may be reduced, thus mitigating shock between the lid assembly and the top cover.

Further, in the washing machine according to an embodiment of the present invention, the lid assembly may be easily opened with less external force.

Further, in the washing machine according to an embodiment of the present invention, the lid assembly may be more securely closed.

Further, in the washing machine according to an embodiment of the present invention, the lid assembly may be automatically closed at a predetermined angle or less, thus improving convenience of use.

Further, in the washing machine according to an embodiment of the present invention, the lid assembly may be automatically opened at a predetermined angle or more, thus improving convenience of use.

Further, in the washing machine according to an embodiment of the present invention, the lid assembly may be designed so that the automatic opening reference angle and the automatic closing reference angle may be anticipated, thus improving predictability of operation.

Further, in the washing machine according to an embodiment of the present invention, the feel of operation of the lid assembly may be improved.

Further, in the washing machine according to an embodiment of the present invention, durability and convenience of use may be improved even when the lid assembly has heavy weight.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A washing machine comprising:

a cabinet open at an upper portion;

a top cover coupled to the upper portion of the cabinet and including an opening for loading and unloading laundry therethrough;

a lid assembly rotatably coupled to the top cover to open and close the opening;

a first hinge unit connecting the lid assembly with the top cover and reducing a speed of closing the lid assembly; and a second hinge unit coupling the lid assembly with the top cover, wherein the second hinge unit includes a fluid which is compressed as the lid assembly rotates so that a rotation speed of the lid assembly is reduced by a repulsive action of the compressed fluid, wherein the first hinge unit includes:

an elastic member; and a cam unit configured to deform the elastic member as the lid assembly rotates and to convert a restoring force exerted from the deformed elastic member to a rotational force, and wherein an elastic modulus of the elastic member is determined so as to provide a sum of a repulsive force of the second hinge unit during the repulsive action and a torque generated in the cam unit by pushing of the elastic member to be lower than a torque caused by the load of the lid assembly.

2. The washing machine of claim 1, wherein the cam unit includes:

a shaft connected to the top cover;

a rotational cam rotating in operative association with the lid assembly; and a reciprocating cam connected to the shaft so that rotation thereof is restricted, and deforming the elastic member as moved by the rotational cam along the shaft.

3. The washing machine of claim 2, wherein the rotational cam includes a conversion surface formed to be inclined with respect to a surface abutting the reciprocating cam so that a moving distance of the reciprocating cam is determined according to a rotational angle of the rotational cam.

4. The washing machine of claim 3, wherein the conversion surface is formed to exert a force in a direction of pressing the reciprocating cam when the lid assembly rotates for closing.

5. The washing machine of claim 3, wherein the reciprocating cam includes an acting surface that is formed to correspond to the conversion surface so that the conversion surface is slidingly rotated.

6. The washing machine of claim 2, wherein the reciprocating cam is moved in a direction of compressing the elastic member when the lid assembly rotates for closing.

7. The washing machine of claim 1, wherein the first hinge unit and the second hinge unit are provided at both sides of the lid assembly, respectively, so that rotational axes of the first and second hinge units are in alignment with a rotational axis of the lid assembly.

8. A washing machine comprising:

a cabinet open at an upper portion;

a top cover coupled to the upper portion of the cabinet and including an opening for loading and unloading laundry therethrough;

a lid assembly rotatably coupled to the top cover to open and close the opening; and a first hinge unit connecting the lid assembly with the top cover, wherein the first hinge unit controls the lid assembly to be closed without external force in a first section as a closing speed of the lid assembly is reduced, and to be opened without external force in a second section including an open angle of 90 degrees or less, wherein the first hinge unit includes:

an elastic member; and a cam unit configured to deform the elastic member as the lid assembly rotates and to convert a restoring force exerted from the deformed elastic member to a rotational force, wherein the cam unit includes:

a shaft connected to the top cover;

a rotational cam rotating together with the lid assembly; and a reciprocating cam connected to the shaft so that rotation thereof is restricted and deforming the elastic member as moved along the shaft by the rotational cam, and wherein an elastic modulus of the elastic member is determined, such that, when the lid assembly is present in the first section, a torque generated in the rotational cam by pushing of the reciprocating cam is lower than a torque caused by the load of the lid assembly, and, when the lid assembly is present in the second section, a torque generated in the rotational cam by pushing of the reciprocating cam is higher than a torque caused by the load of the lid assembly.

9. The washing machine of claim 8, wherein the rotational cam includes a conversion surface formed to be inclined with respect to a surface abutting the reciprocating cam so that a moving distance of the reciprocating cam is determined according to a rotational angle of the rotational cam, and wherein the conversion surface is formed to be inclined so that a torque is generated in a direction of closing the lid assembly in the first section and a torque is generated in a direction of opening the lid assembly in the second section.

10. The washing machine of claim 8, further comprising:

a second hinge unit that reduces a rotation speed of the lid assembly.

11. The washing machine of claim 10, wherein a torque capacity of the first hinge unit, a torque capacity of the second hinge unit, and a weight of the lid assembly are determined so that the lid assembly is closed without external force in the first section and opened without external force in the second section.

12. The washing machine of claim 11, wherein in the first section, a resultant torque according to a torque generated by the first hinge unit, a torque generated by the second hinge unit, and a torque generated by the weight of the lid assembly, is acted on the lid assembly in a direction for closing, and in the second section, the resultant torque is acted on the lid assembly in a direction for opening.

13. The washing machine of claim 11, wherein a ratio of the torque capacity generated by the first hinge unit to the torque capacity generated by the second hinge unit is 8:2.

14. The washing machine of claim 11, wherein a ratio of the torque capacity generated by the first hinge unit to the torque capacity generated by the second hinge unit is 7:3.

15. The washing machine of claim 11, wherein a ratio of the torque capacity generated by the first hinge unit to the torque capacity generated by the second hinge unit is 6:4.

16. The washing machine of claim 8, wherein the first section includes an open angle ranging from 60 to 80 degrees.

17. The washing machine of claim 8, wherein the second section includes an open angle not more than 90 degrees.

18. The washing machine of claim 17, wherein the second section includes an open angle ranging from 80 to 90 degrees.

19. The washing machine of claim 8, wherein the first hinge unit controls the lid assembly so that when the lid assembly rotates for closing, a rotating speed of the lid assembly is increased in a third section after the first section is passed.

20. The washing machine of claim 19, wherein the first hinge unit generates a torque in a different direction between the first section and the third section.

21. A washing machine comprising:

a cabinet open at an upper portion;

a top cover coupled to the upper portion of the cabinet and including an opening for loading and unloading laundry therethrough;

a lid assembly rotatably coupled to the top cover to open and close the opening; and a first hinge unit connecting the lid assembly with the top cover, wherein when the lid assembly rotates for closing, the first hinge unit reduces a rotating speed of the lid assembly in a first section, and increases a rotating speed of the lid assembly in a third section after the first section is passed, wherein the first hinge unit includes:

an elastic member deformed as the lid assembly rotates; and a cam unit configured to convert a restoring force of the deformed elastic member to a rotational force and to generate a torque in a direction of opening the lid assembly in the first section and a torque in a direction of closing the lid assembly in the third section, wherein the cam unit includes:

a shaft connected to the top cover;

a rotational cam rotating together with the lid assembly; and a reciprocating cam connected to the shaft so that rotation thereof is restricted and deforming the elastic member as moved by the rotational cam along the shaft, and wherein the elastic member modifies the direction of the torque generated in the rotational cam by the reciprocating cam by at least once relaxation of the elastic member and at least once contraction of the elastic member while the lid assembly is moved from a fully opened state to a fully closed state.

22. The washing machine of claim 21, wherein the lid assembly is rotated for closing passing the first and third sections sequentially.

23. The washing machine of claim 21, wherein the first hinge unit generates a torque in a direction of opening the lid assembly in the first section and generates a torque in a direction of closing the lid assembly in the third section.

24. The washing machine of claim 21, wherein the reciprocating cam is formed with a crest and a plurality of troughs, and wherein the rotational cam includes a conversion surface converting a force exerted from the reciprocating cam to a rotational force, and wherein the contraction occurs while the conversion surface is moved from one of the plurality of troughs to the crest, and the relaxation occurs while the conversion surface is moved from the crest to another trough.

25. The washing machine of claim 24, wherein the conversion surface includes a first inclined surface corresponding to the first section and a second inclined surface corresponding to the third section, and wherein the second inclined surface is inclined in an opposite direction from the first inclined surface, so that a torque is generated in a different direction between the first section and the third section by a force exerted from the reciprocating cam.

26. The washing machine of claim 25, wherein the reciprocating cam includes an acting surface formed corresponding to the conversion surface and being in face-to-face contact with the conversion surface.

27. The washing machine of claim 21, further comprising:

a second hinge unit coupling the lid assembly with the top cover, wherein the second hinge unit includes a fluid which is compressed as the lid assembly rotates so that a rotation speed of the lid assembly is reduced by a repulsive action of the compressed fluid.

* * * * *